US005760739A

United States Patent [19]

Pauli

[11] Patent Number: 5,760,739

[45] Date of Patent: Jun. 2, 1998

[54] METHOD AND APPARATUS FOR AIMING A DIRECTIONAL ANTENNA

[76] Inventor: Richard A. Pauli, 614 W. Halladay St., Seattle, Wash. 98119

[21] Appl. No.: 721,649

[22] Filed: Sep. 26, 1996

Related U.S. Application Data

[60] Provisional application No. 60/023,905 Aug. 14, 1996.

[51] Int. Cl.[6] ..... H01Q 3/00

[52] U.S. Cl. ..... 342/359; 343/757; 343/760

[58] Field of Search ..... 342/359; 33/270; 343/757, 760, 894

[56] References Cited

U.S. PATENT DOCUMENTS

| | | | |
|---|---|---|---|
| 4,081,911 | 4/1978 | Eldridge | 33/270 |
| 4,691,207 | 9/1987 | Timineri . | |
| 4,835,875 | 6/1989 | Fuller | 33/270 |
| 4,945,644 | 8/1990 | Fuller | 33/270 |
| 5,077,560 | 12/1991 | Horton et al. . | |
| 5,077,561 | 12/1991 | Gorton et al. . | |
| 5,197,199 | 3/1993 | Shrader | 33/270 |
| 5,296,862 | 3/1994 | Rodeffer et al. . | |
| 5,347,286 | 9/1994 | Babitch . | |
| 5,424,750 | 6/1995 | Akisada . | |
| 5,459,931 | 10/1995 | Waltho . | |
| 5,471,219 | 11/1995 | Rodeffer et al. . | |
| 5,493,310 | 2/1996 | Ota . | |
| 5,515,058 | 5/1996 | Chaney et al. . | |
| 5,583,514 | 12/1996 | Fulop | 342/359 |
| 5,589,837 | 12/1996 | Soleimani et al. | 342/359 |
| 5,590,093 | 12/1996 | Scharstein et al. . | |
| 5,596,553 | 1/1997 | Kellogg . | |

OTHER PUBLICATIONS

Walle, A.C., "The Sunshine–Shadow Method of Locating Satellites and Boresighting Dishes," *Satellite Retailer*, Triple–D Publishing, Shelby, NC, Dec., 1995.

Anguish, Scott, *DBS Online: Satellite Locator*, 1996.

Small, Warren, "Sun Outage Finder," Satellite Dish Utility Version 3.32, User Guide, 1988.

Telsat Communications Ltd., *TVRO Software*, Palmerston North, New Zealand, Jun. 4, 1996, <http://www.nethome-s.com/telsat>.

*Primary Examiner*—Thomas H. Tarcza
*Assistant Examiner*—Dao L. Phan
*Attorney, Agent, or Firm*—Crowell & Moring LLP

[57] ABSTRACT

A method and apparatus for aiming a satellite dish includes an adjustable gnomon. The adjustable gnomon is calibrated. Using setting information generated by computer softwvare, a user sets the gnomon according to the calibration numbers returned by the computer software. The user then lock the setting into place. After locking the gnomon into position, the user employs the gnomon to aim a satellite dish or other directional antenna. Aiming the antenna requires aligning the antenna such that a shadow cast by the gnomon substantially coincides with a predetermined target.

20 Claims, 11 Drawing Sheets

METHOD AND APPARATUS FOR AIMING A DIRECTIONAL ANTENNA

CROSS REFERENCE TO RELATED APPLICATIONS

This application is a continuation-in-part of U.S. Provisional Application Ser. No. 60/023,905, filed Aug. 14, 1996 (Attorney Docket No.: PAU-101-PRO).

BACKGROUND

1. Field of the Invention

The present invention relates to aiming a directional antenna. More particularly, the present invention relates to aiming a directional antenna by maneuvering the antenna to force a shadow cast by a calibrated adjustable gnomon to substantially coincide with a pre-determined target co-located with the directional antenna.

2. Background of the Invention

Satellite dish receivers have become popular in recent years primarily for use in home television receiving systems. A satellite dish receiver has a dish-shaped receiving antenna. The dish-shaped receiving antenna collects and focuses an incoming transmission beam transmitted by a satellite. The transmission beam carries a signal of interest, for example a television broadcast. Upon striking the dish-shaped antenna, the transmission beam is focused by the parabolic surface of the dish to a center mounted waveguide and receiver.

Satellite dish receivers and satellite dish transmitters are highly directional antennas. As a result, they must be precisely aimed at a desired broadcasting satellite for proper operation. Aiming is also referred to as tuning. Generally, the dish is aimed at a pointing, or look, window. The pointing window is the window in which the satellite is expected to be located. Aiming is generally performed by setting the azimuth and elevation angle of the dish. The pointing window for aiming the dish is very small.

The size of the look window is a function of the power of the satellite transmission signal, the shape of the transmission footprint, and the manufactured construction tolerances of the dish. To assure proper set up, software applications are typically used to calculate azimuth and elevation angles for the look window to thousandths of a degree. One such a software application is the AIMIT software from Broadcast Software International, Inc., 20165 North 67th Avenue, Suite 122A, Glendale, Ariz. 85308 (BSI). High accuracy is required because even slight deviations (traverses on the order of 1 inch left or right) from the correct alignment of the dish can result in a rapid decrease in signal power received from the arriving transmission beam. Users recognize the decrease in the received signal power as a significant reduction in television reception quality.

Television satellites are generally placed in geo-synchronous orbits. The geo-synchronous or geo-stationary satellite orbit is approximately 23,000 miles above the equator. As a result, geo-synchronous satellites are virtually impossible to see with the naked eye. Even telescopic aides provide little help in locating these satellites visually. Because the sky appears empty to the average person, it is extremely difficult to aim a satellite dish antenna without an aide.

Due to this difficulty of finding the satellites, various methods of satellite dish installation have been devised. The current process of aiming the satellite dish antenna is difficult, time-consuming, and costly. Conventional manual aiming techniques require the use of a compass and protractor to measure the azimuth and elevation of the look window.

Conventional aiming also involves metering the electronic signal received by the dish. Metering requires moving the dish in small increments and maximizing the received signal until the proper aim to satellite is determined. After the dish has been precisely aimed, it is locked into place. Unfortunately, if the dish is moved, either intentionally or accidentally, it needs to be re-aimed.

All conventional metering methods for setting up a dish antenna involve powered-up electronic circuits. One early method involved fully connecting and powering up the satellite dish-based television system. A first installer adjusted the satellite dish while a second installer, or assistant, observed the television reception. The first installer adjusted the satellite dish until the second installer indicated that the television picture was of satisfactory quality. Requiring two installers is costly and inefficient. Thus, methods for installation requiring only one installer were developed. One conventional single-installer method involves an electronic cable attached to a fully operational receiver station carrying a signal back to a meter attached to a satellite dish. The dish installer observes a signal strength meter at the dish. The signal strength meter measures the signal strength of the received signal. The installer adjusts the satellite dish antenna until the meter indicates that the received signal strength is at its greatest. No assistant is required. Often, the installer must perform a systematic sweep across the look window to precisely aim the dish. After aiming, the signal cable and the meter on the dish are no longer needed. The entire dish-based television system needs to be fully powered and operational for the setup to succeed.

A second conventional one-installer method of metering uses a small LED indicator on the back of the dish to indicate a strong signal capture. The installer pans the pointing window until the LED lights up. Initially, acquiring the desired signal however, poses a considerable problem.

A sundial is a device that determines the time of day using the shadow of the sun. After the sundial is oriented and tuned, it provides an indication of the approximately correct time. A more complete description of a sundial can be found in Waugh, Albert E., "Sundials - Their Theory and Construction," (Dover Books, London/ N.Y. 1973), herein incorporated by reference in its entirety. The astrolabe is a device that uses the time-of-day and the angle to the sun, moon or stars to determine position on the planet. A more complete description of an astrolabe can be found in North, J.D., "The Astrolabe," *Scientific A American,* 230:1, 96–106 (January 1974), and Gaunter, Robert T., "Astrolabes of the World," ISBN 0-87556-604-9 (Safer), originally published by University Press, Oxford (1932) each herein incorporated in its entirety.

Using the principles of a sundial and an astrolabe, the present invention solves the problem of aiming a satellite receiving dish to a precise location of a satellite in space.

GLOSSARY

As used in this specification, the following terms have the indicated meanings.

adjustable gnomon—A gnomon that can be adjusted on multiple axes.

antenna—Receiving or transmitting hardware for picking up or transmitting electromagnetic energy. An antenna is optimized in size, shape and orientation relative to a specific signal.

CAG—A calibrated adjustable gnomon has a gnomon and target. The orientation relationship between the gnomon and the target can be adjusted by the user in calibrated increments on either the gnomon or the target or both. Thus, a CAG according to the preferred embodiments of the present invention includes a CAG having a fixed target and an adjustable gnomon or a fixed gnomon and an adjustable target.

co-located—attached to, either directly or indirectly. A CAG shadow target is referred to as co-located with a directional antenna. For example, such targets, can be embedded in or emblazoned on the directional antenna.

geo-stationary orbit—The circular orbit at approximately 23,000 miles above the equator. Satellites slotted in this orbit appear at substantially the same position in the sky described in degrees towards East (E or positive) or West (W or negative) from the Greenwich meridian.

geo-synchronous satellite—A satellite that is substantially stationary relative to any fixed position on the surface of the earth. A geo-synchronous satellite orbits the earth above the equator with a period of approximately 24 hours. Geo-synchronous satellites are also known as geo-stationary satellites.

gnomon—An object or objects that serves as an indicator by the position of a shadow that the object or objects cast. For example, the arm of a sundial is a gnomon because it conveys information by its shadow.

look angle—The angle at which a mounted directional antenna must be set to see a satellite along the axis of perfect alignment. A look angle is also called the look window and the position angle.

shadow—a delineated area noted for a lack of radiation, for example an umbra on a sundial.

target—A set point or a marked goal to be aimed for existing in a relationship with a gnomon. The targets of the present invention are co-located with a directional antenna.

SUMMARY OF THE INVENTION

The present invention solves the problems associated with aiming a directional antenna by using a shadow cast by the sun to simplify antenna aiming. To aim a directional antenna, a user obtains setting information for a calibrated adjustable gnomon (CAG). The setting information indicates the proper settings for the CAG. The user then adjusts the CAG according to the setting information. After the CAG has been properly set, the user aligns the directional antenna by maneuvering it such that a shadow cast by the CAG substantially coincides with a pre-determined target co-located with the antenna.

Preferably, the setting information is obtained using a computer program. To obtain the setting information, the user inputs the date, the time, and the user's location. The user's location is preferably determined by converting the user's zip code to latitude and longitude. The computer program processes the inputs to produce the appropriate setting information for a particular CAG.

The present invention is also a calibrated adjustable gnomon (CAG). As described above, the CAG is used to aim a directional antenna. In direct sunlight, the CAG casts a shadow on a target holding surface co-located with the directional antenna. The CAG is attached to the directional antenna either by the manufacturer of by the users through a retrofitting procedure. The CAG is generally mounted on the directional antenna. The CAG is then set according to setting information output by a computer program. Once set, the user aligns the shadows as described above.

In the present invention, the CAG is set using user supplied information, including: well-known mathematics, the time-of-day, the date, and the locations of the directional antenna and of the specified geo-synchronous satellite. Using the aforementioned information, a computer software application generates numeric setting information for the CAG. The CAG is adjusted in accordance with the numerical settings indicated by the computer software. Once adjusted, the CAG is set and locked into position. With the CAG locked, the directional antenna can be simply aimed.

The present invention not only makes aiming a directional antenna easier and less expensive, it also improves the safety of installing a directional antenna. First, the installer no longer needs to look directly at a potentially blinding sun. Secondly, the installer does not have to handle any of the antenna's electronics, thereby make handling of the antenna during installation easier.

Thus, one object of the present invention is to make a directional antenna less expensive to manufacture.

Another object of the present invention is to make a directional antenna easier to aim.

Yet another object of the present invention is to make a directional antenna less expensive to install.

Still another object of the present invention is to eliminate the need for special equipment and difficult, time-consuming set-up procedures when installing a directional antenna.

A further object of the present invention is to improve the safety of installing a directional antenna.

Another object of the present invention is to eliminate the need to fully power up a satellite dish television receiving system during dish installation.

Yet another object of the present invention is to use the properly aimed orientation of a directional antenna to one satellite to enable aiming to a different satellite.

These and other objects of the present invention are described in greater detail in the detailed description of the invention, the appended drawings and the attached claims.

DETAILED DESCRIPTION OF THE INVENTION

The present invention is directed to simplifying the process of aiming a directional antenna. According to a preferred embodiment of the present invention, a user obtains setting information for a calibrated adjustable gnomon (CAG). The use then sets the gnomon according to the setting information. The user then maneuvers the directional antenna until a shadow cast by the CAG substantially coincides with a pre-determined target co-located with the directional antenna.

Figure 1A:
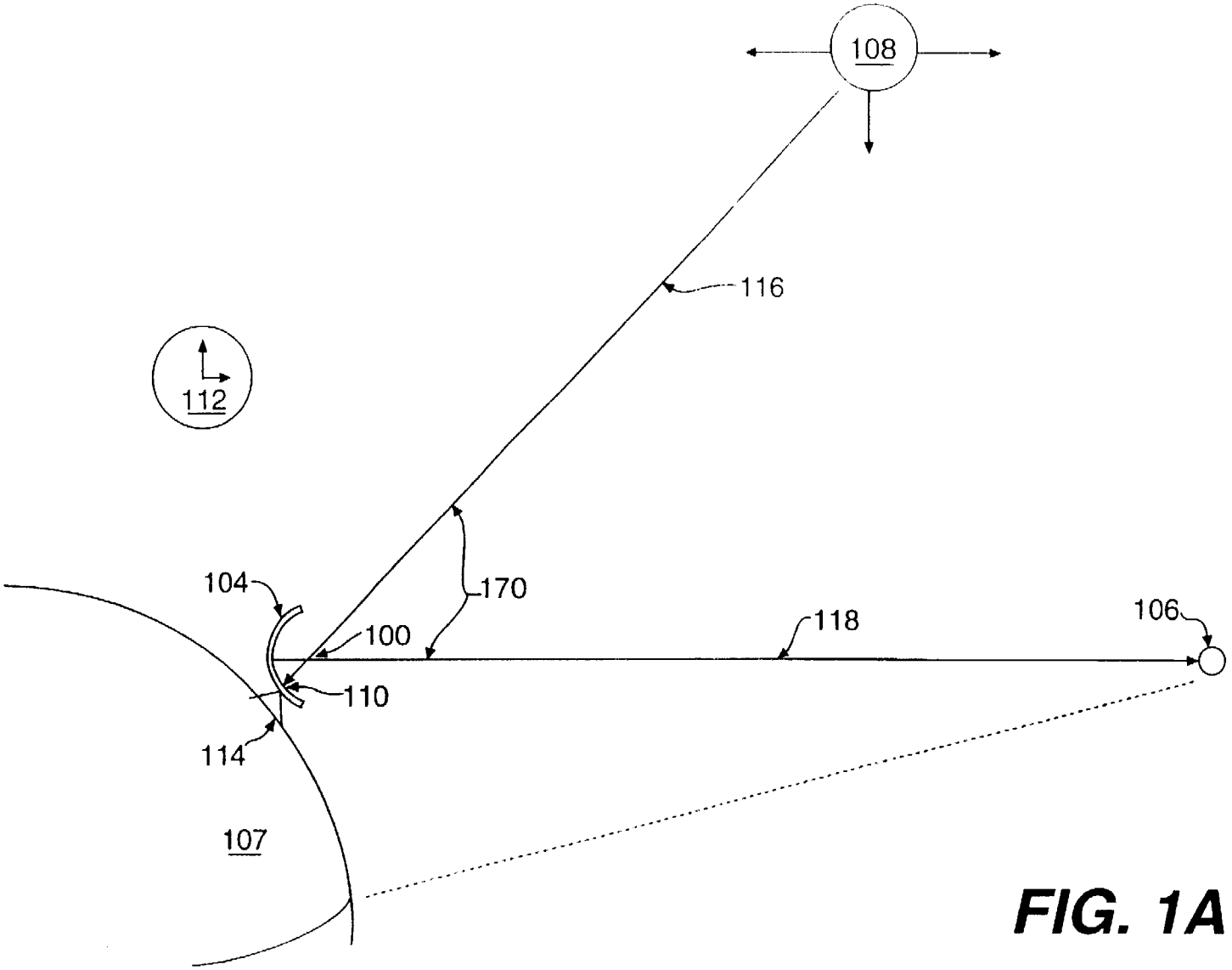
FIGS. 1A and 1B illustrate the geometry of relationships of the objects required for the present invention.
Figure 1B:
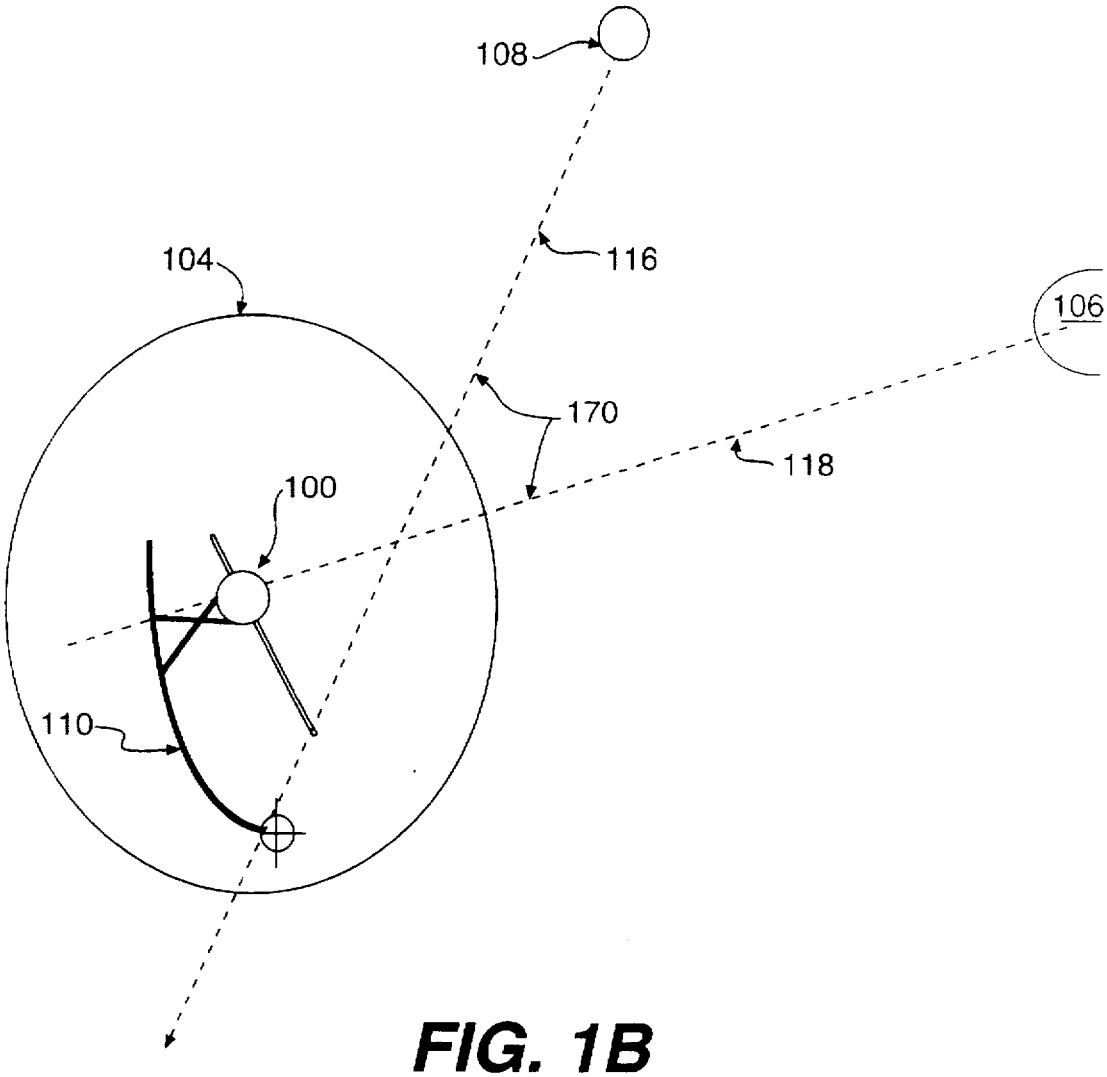

FIGS. 1A and B illustrate the geometric relationships according to which the present invention operates. A fundamental understanding of the geometry will facilitate understanding the ensuing disclosure of the present invention. As illustrated in FIGS. 1A and 1B, the key components of the system in which the present invention operates includes a calibrated adjustable gnomon (CAG) 100, an antenna 104, a desired satellite 106, the earth 107, and the sun 108. The satellite 106 is in geo-synchronous orbit and the position of the directional antenna 104 is fixed. Thus, the directional antenna 104, the earth 107, and the satellite 106 form a system of substantially motionless objects relative to one another. As a result, the system can be described in terms of relatively simple geometry as shown in FIGS. 1A and 1B. The known location 114 of the directional antenna 104 and the location of the satellite 106 form two points on the line of transmission 118 along which the directional antenna 104 must be aligned in order to properly receive a satellite transmission. A line of solar radiation 116 between the sun 108 and the directional antenna 104 is constantly changing but may be rigidly defined for any specific time of day. The geometry is such that at a particular day and time a CAG 100, that has been appropriately set, causes a solar shadow to be cast that substantially coincides with a target co-located at the antenna when the antenna is aimed at the satellite 106. Setting the CAG 100 is described below.

The stationary geometry creates a simple trigonometric relationship between the sun 108, the directional antenna 104, and the satellite 106. This trigonometric relationship is captured by an angle 170. The geometrical and trigonometrical relationships can be modeled mathematically in a well-known manner. An example mathematical model of the system can be found in Clifford, Marvin, "The Complete Guide to Satellite TV," pp. 226–231, Tab Books, 1984, hereby incorporated by reference in its entirety. The model can be reduced to a computer useable form by those skilled in the art. Using this model, a computer program can be developed to determine the appropriate CAG settings to which to set the CAG 100 for use with the method of the present invention. It would be apparent to those skilled in the art to develop such a program based on the disclosure herein.

As shown in FIGS. 1A and 1B, in the above described system, the sun 108 causes the CAG 100 to cast a shadow 110 on the directional antenna 104. A user adjusts the antenna 104 according to the method of the present invention. (described below). To properly align the antenna to receive a transmission signal from the satellite 106.

With this description of the system in which the present invention operates, a method according to a preferred embodiment of the present invention is explained. Referring to a FIG. 1A, the user must initially determine the latitude and longitude of the location 114 of the directional antenna. The position of the directional antenna on the earth 114 can be determined as accurately as desired. In the preferred embodiment, zip codes are used. The user enters his or her zip code into a computer program. The computer program outputs the latitude and longitude of the entered zip code, i.e., the location 114 of the directional antenna 104. A commonly used computer program for this purpose is AIMIT from BSI, Inc.

The resolution obtained by using the zip code has been determined to be sufficient for the operation of the present invention. Higher resolution can be obtained with 9-digit zip codes if desired. The higher resolution yielded by the 9-digit zip code provides greater accuracy in the location of the latitude and longitude of the directional antenna.

In the preferred embodiment, the calculation involves a look-up using a lookup table. The lookup table contains zip codes corresponding to latitudes and longitudes. The lookup table is indexed by the zip code to return the appropriate latitude and longitude for that zip code. It would be apparent to those skilled in the art that there are other mechanisms by which the latitude and longitude can be determined from the zip code. For example, lists of zip codes and corresponding latitudes and longitudes can be obtained from various Internet Web pages in a well-known manner. Various antenna aiming programs use the location of the antenna, often described as longitude and latitude in calculating the look window for that satellite. A different location will yield a different look window for that same satellite. For example, the DSS satellite look window can be found by accessing the URL: "http:\\www.dbs.digifix.com/cgi-bin/DSSPoint." The latitude and longitude information can also be obtained from a variety of other sources including automatic telephone source, technical support, and/or point of sale.

Alternatively, the user can supply the location 114 of the directional antenna 104 to the program by inputting the name of the city, town, or other area in which they live. The software in this case needs to store, or have access to (e.g., Internet), latitude and longitude information for any likely city or town names. Performing such storage or access is well known to those skilled in the art.

A third alternative for obtaining latitude and longitude involves using the Global Positioning System (GPS). In step 204 a GPS, navigation or computer platform can provide the location. The computing platform is preferably a personal computer or a terminal connected to a computer having software runing thereon to perform the calculation.

To align the CAG 100 according to the method of the present invention, the user must mount the CAG 100 on the antenna 104. Preferably the CAG 100 is mounted by the directional antenna manufacturer as described below. However, manufacturer mounting is not necessary. As described below, the CAG 100 of the present invention can be mounted though a retrofit. Once the CAG is attached to the antenna, the user must determine the proper CAG settings. When the CAG is set to the proper CAG settings, the user can maneuver (adjust) the directional antenna until a target on the antenna substantially aligns with a shadow cast by the CAG. After alignment, the directional antenna will point to its intended satellite or other particular object. Though described with reference to the earth 107, the present invention can be employed on any celestial body illuminated by a sun, including the earth's moon or other planets.

Figure 2:
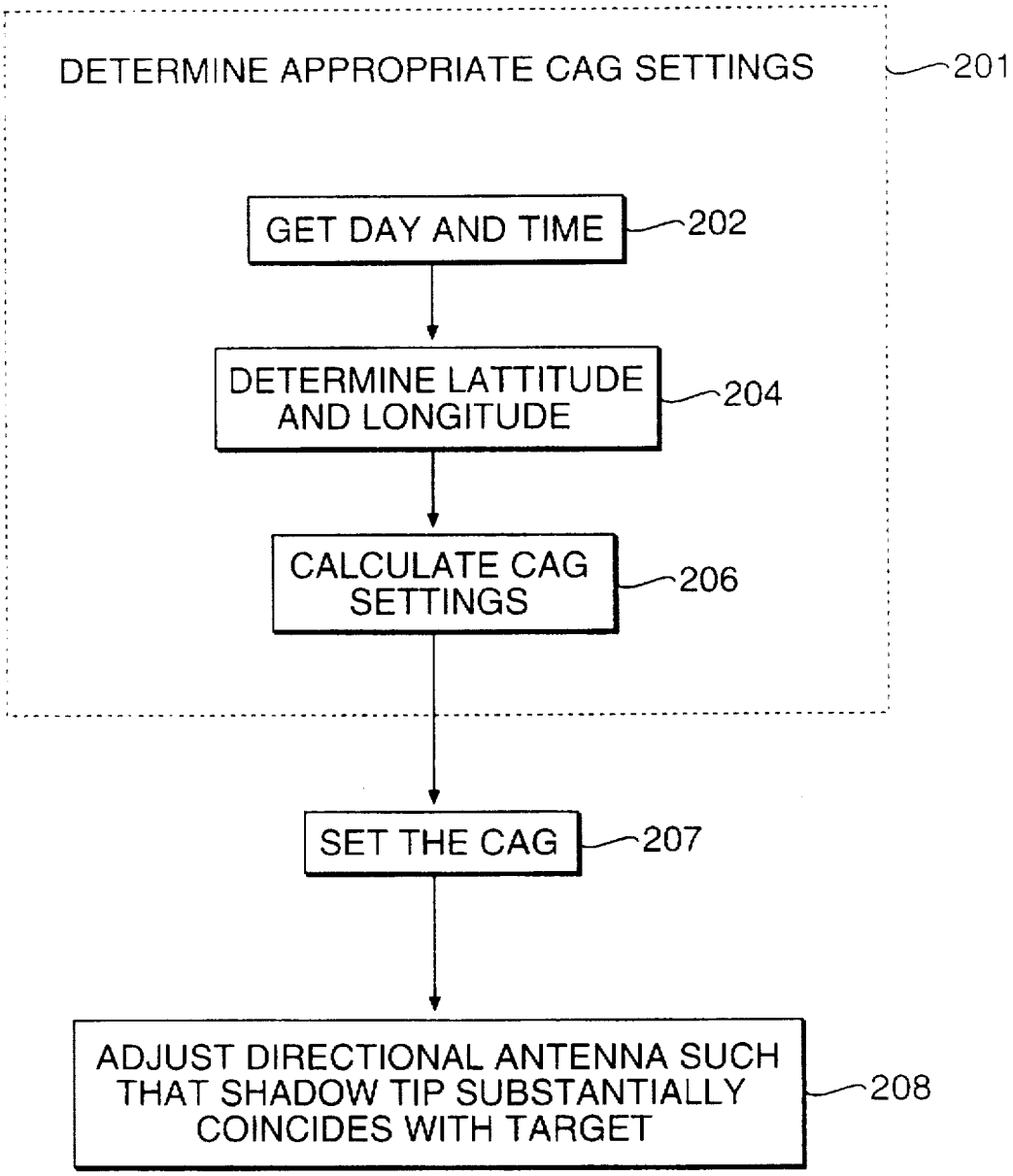
FIG. 2 illustrates a flow chart for aiming the directional antenna.

Referring to FIG. 2, the preferred method for aiming the directional antenna is explained. In step 201, the user determines the appropriate CAG settings. Step 201 includes steps 202, 204, and 206. In step 202, the user or computer notes the time of day in a well-known manner. To determine the proper CAG settings, the user must know his/her location as zip code or latitude and longitude and the time of day. In step 204, the user determines latitude and longitude as described above.

After obtaining the latitude and longitude, the user inputs this information to the computer. The computer, in step 206, performs a calculation using the latitude, longitude, and the time of day to determine the appropriate settings for the particular CAG 100 being used. Preferably, the computer program is an extension of the lookup table described above. Thus, the user only has to enter the zip code and the time of day. The appropriate CAG 100 settings are then returned to the user. Alternatively, the user can input the latitude, longitude, and the time of day as input to a computer program that returns the appropriate CAG settings.

Specialized software is required for each embodiment of the CAG 100 described below. It would be apparent to those skilled in the art how to develop the requisite software for a given embodiment of the CAG 100, given the geometric relationships illustrated in FIG. 1.

After determining the appropriate CAG 100 settings, the user adjusts the CAG 100 to those settings in step 207. The user then locks the (CAG 100 into place in step 207. At this point the CAG 100 is appropriately set such that the directional antenna will be properly aimed when a shadow cast by the CAG 100 substantially coincides with a target on the directional antenna.

The only remaining step is to adjust the directional antenna such that the shadow 110 cast by the CAG 100 substantially coincides with a target co-located with the directional antenna. This is performed in step 208. In step 208, the user adjusts the directional antenna until a shadow cast by the gnomon substantially coincides with a target co-located with the directional antenna.

In the preferred embodiment, the directional antenna is mounted on an antenna mount. The antenna mount permits adjustment of the antenna in azimuth and elevation. Thus, in the preferred embodiment, the user adjusts the azimuth and elevation of the antenna to force the shadow to substantially coincide with the target co-located with the antenna.

Figure 3:
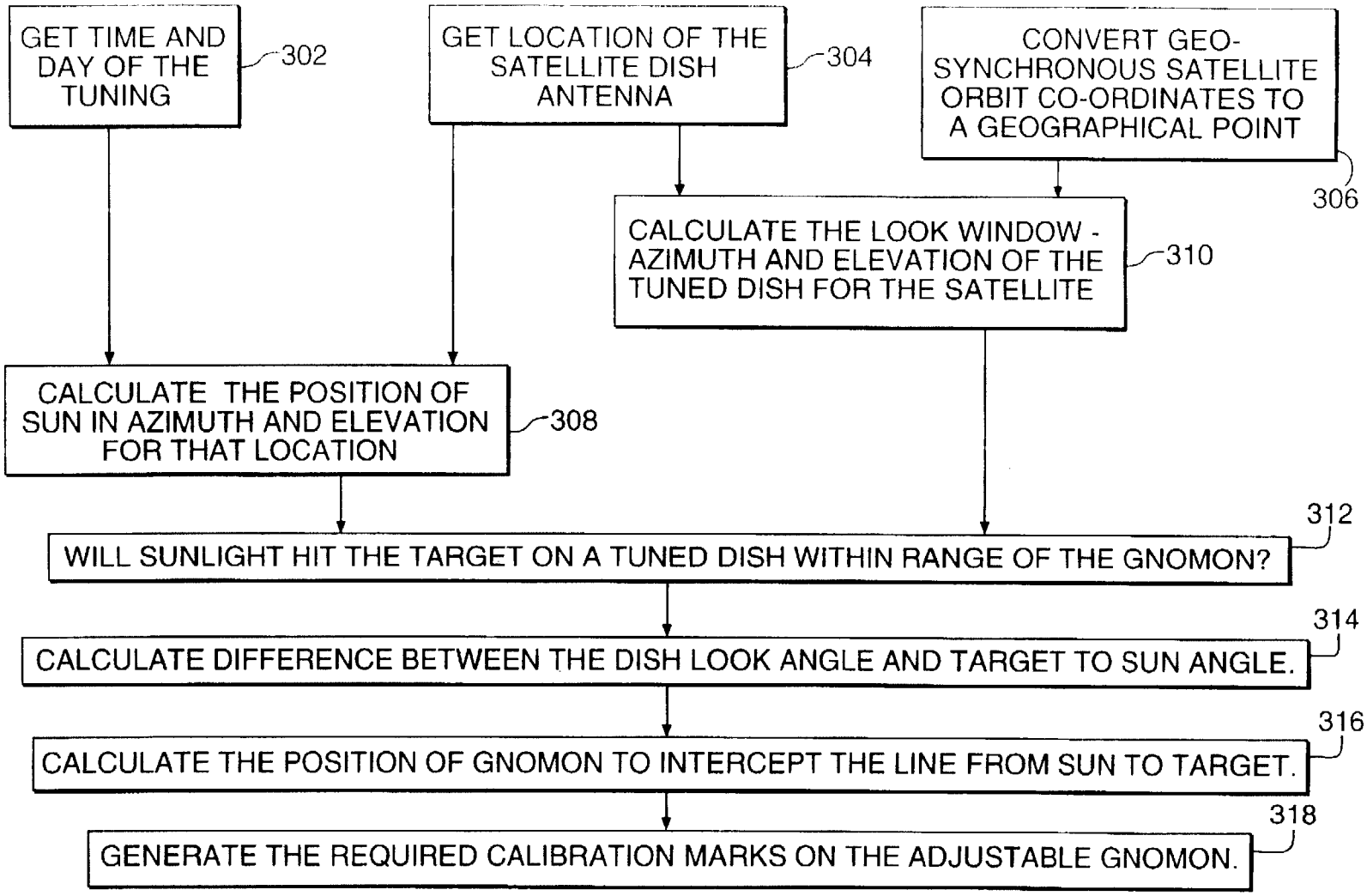
FIG. 3 illustrates a software flow chart for deriving the gnomon settings.

FIG. 3 illustrates the flow chart of the calculations necessary to derive the settings for the CAG 100. The calculations in FIG. 3 are preferably performed on a computer (not shown). Referring to FIG. 3, the software begins in step 302. In step 302, the software determines the time of day of the tuning (aiming). This determination can be made in several ways including, data input by the user or by sampling the computer's system clock. The software then executes step 304. In step 304, the software determines the location of the satellite dish. Generally, the software makes this determination based on location data supplied by the user as described above. The software continues in step 306. In step 306, the software converts geo-synchronous satellite orbit coordinates to a geographical coordinate system (e.g., azimuth, elevation, and altitude). This is generally performed by converting satellite ephemeris data to the desired geographical coordinate system in a well-known manner.

Next the software performs two preliminary calculations. From the time of day and the location of the directional antenna, the software calculates the position of the sun in azimuth and elevation for that location. The calculation is preformed in step 308 in a well-known manner. From the location of the directional antenna and the converted satellite data, the software calculates the azimuth and elevation required for a properly tuned directional antenna to observe the look window for the desired satellite. The calculation is performed in step 310.

Next, in step 312, the software determines whether sunlight hits the target on a tuned directional antenna within the range of the gnomon. Step 312 constrains the range of setup times to times when sunlight is able to strike the face of the dish. For example, step 312 eliminates early morning setup times for a Western facing dish. The software then, in step 314 calculates the difference between the proscribed dish look angle and the angle to the sun. Based on this information, the software, in step 316, determines the position of the gnomon that is required for the gnomon to intercept the line from the sun to the target (co-located with the directional antenna). Using the position required determined in step 316, the software, in step 318, generates the required calibration mark output for the user. The user then sets the CAG using the calibration mark information supplied by the software as described above.

Another aspect of the present invention is the CAG 100 used to cast the shadow. A key advantage of the CAG 100 of the present invention over conventional gnomons is that the CAG 100 of the present invention is adjustable. The following description of the CAGs of the present invention illustrate several embodiments. Each embodiment illustrates the adjustable nature of the CAGs of the present invention.

Figure 4A:
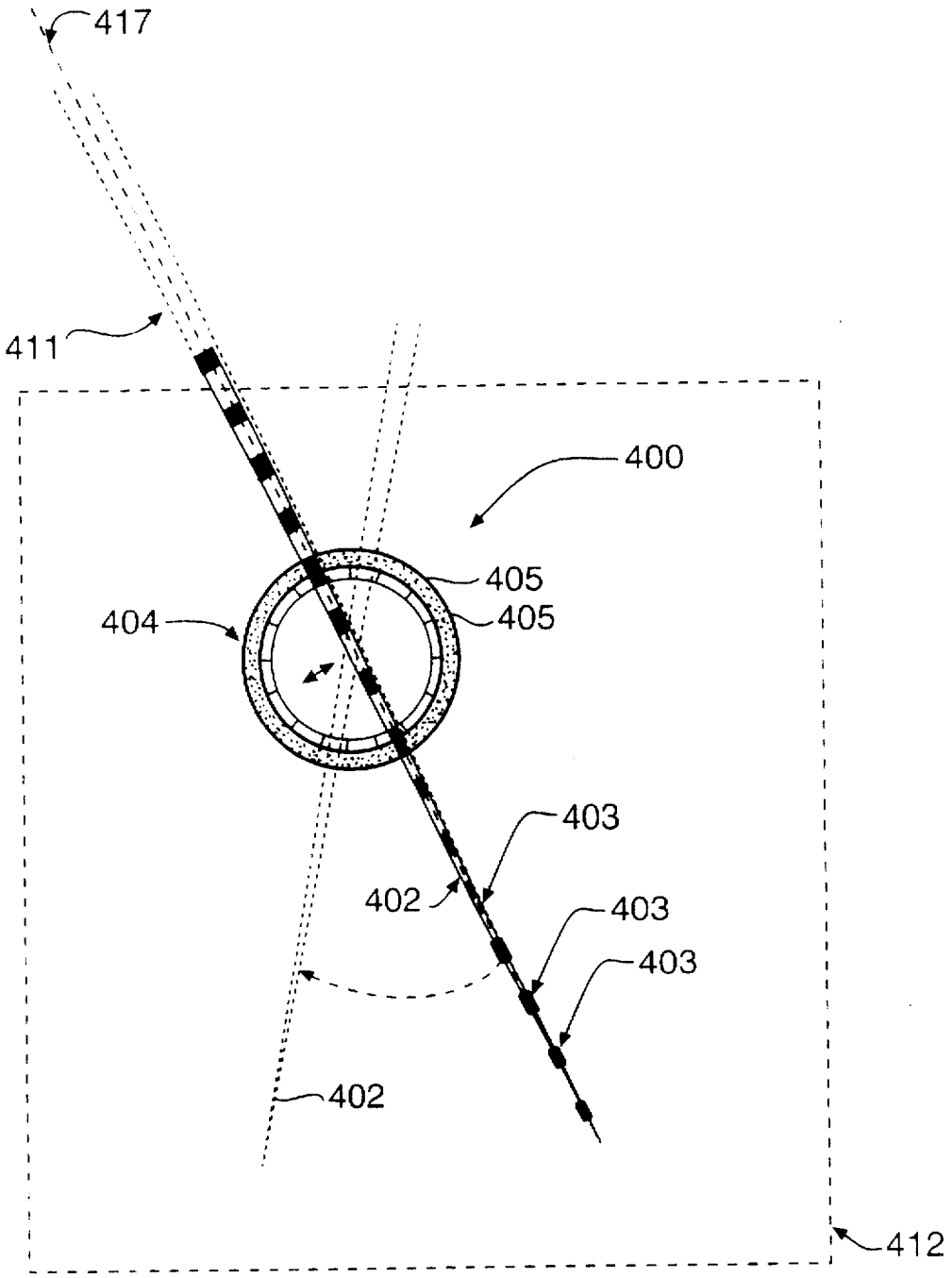
FIGS. 4A and 4B illustrate a calibrated adjustable gnomon (CAG) according to a preferred embodiment of the present invention.
Figure 4B:
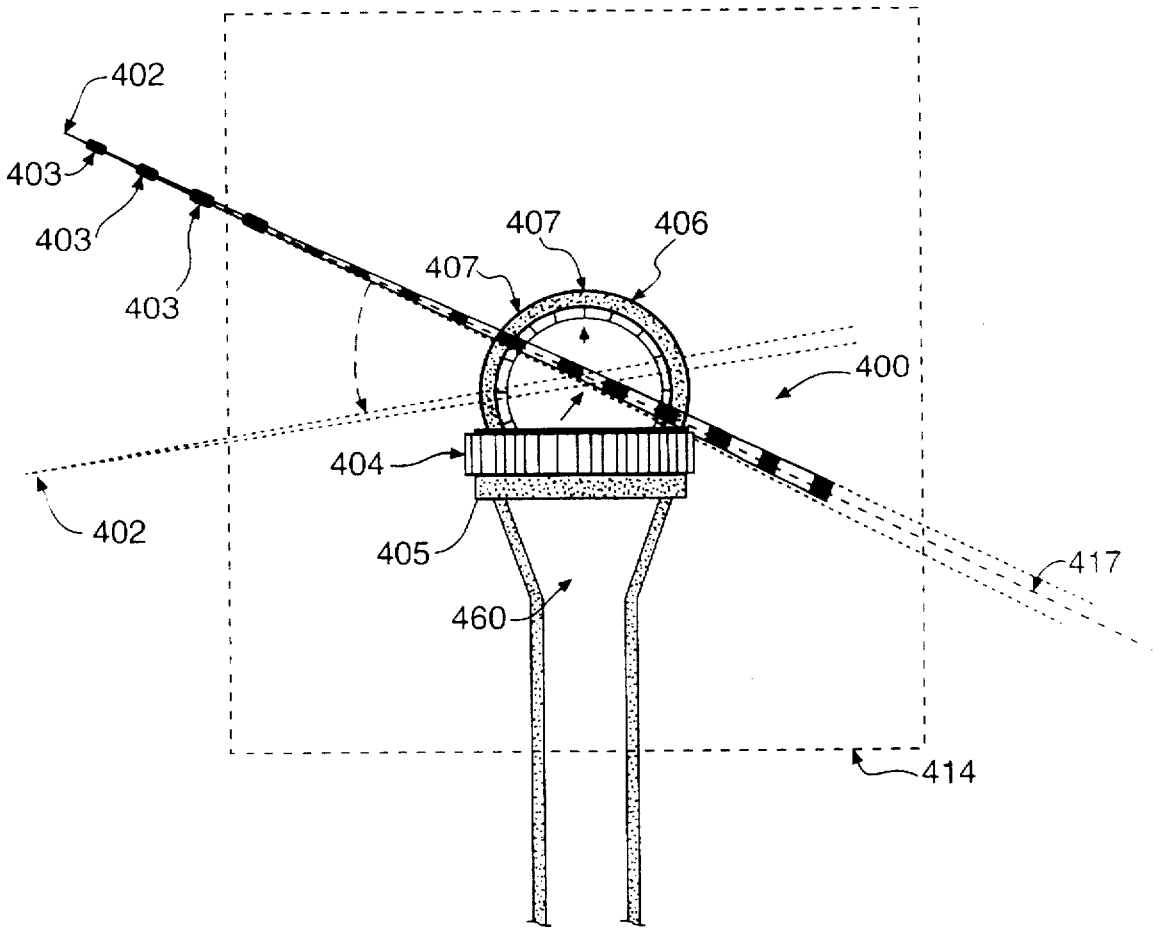

FIGS. 4A and 4B illustrate a calibrated adjustable gnomon (CAG) 400 according to a preferred embodiment of the present invention. Referring to FIG. 4A, the CAG 400 has a gnomon 402 and a mechanism by which to adjust the gnomon 402 along multiple axes. Preferably, the gnomon 402 can rotate in two planes. A first plane of rotation 412 allows the gnomon 402 to be adjusted in azimuth. The second plane of rotation 414 allows the gnomon 402 to be adjusted in elevation (see FIG. 4B). Azimuth adjustment is accomplished by rotating the gnomon 402 using rotational device 404. Elevation adjustment is accomplished by rotating the gnomon 402 using the rotational device 406. The rotational devices 404 and 406 can be rotating devices themselves, or fixed devices about which the gnomon 402 rotates. The gnomon 402 can also be adjusted along its transversal axis 417. Each of the three axes adjustments is positioned using calibration marks. The transversal adjustment has calibration marks 403, the azimuth adjustment has calibration marks 405, and the elevation adjustment has calibration marks 407.

Such multiple axes adjustment mechanisms are well-known in the art. For example, multiple-axis adjustment mechanisms are often used on can be found on a photographic tripod head, and in optics laboratories. A supplier of such devices is Melles Griot, Inc. Electro-Optics Instruments, 4601 Nautilus Court South, Boulder, Colo. 80301.

When using a CAG 400 to aim the satellite dish, a user obtains the requisite gnomon settings by executing a software application as described above. The requisite gnomon settings indicate the azimuth calibration mark 405 for rotation device 404, the elevation calibration mark 407 for rotation device 406, and the transversal calibration mark 403 to use. The user then adjusts the CAG 400 according to the calibration settings returned by the software. That is, the user rotates the rotational devices 404 and 406 (or alternatively rotates the gnomon 402 about the rotational devices 404 and 406) to the indicated calibration mark 405 and 407 respectively, and adjusts the gnomon 402 along its transversal axis to the calibration mark 403 indicated by the software.

Figure 5:
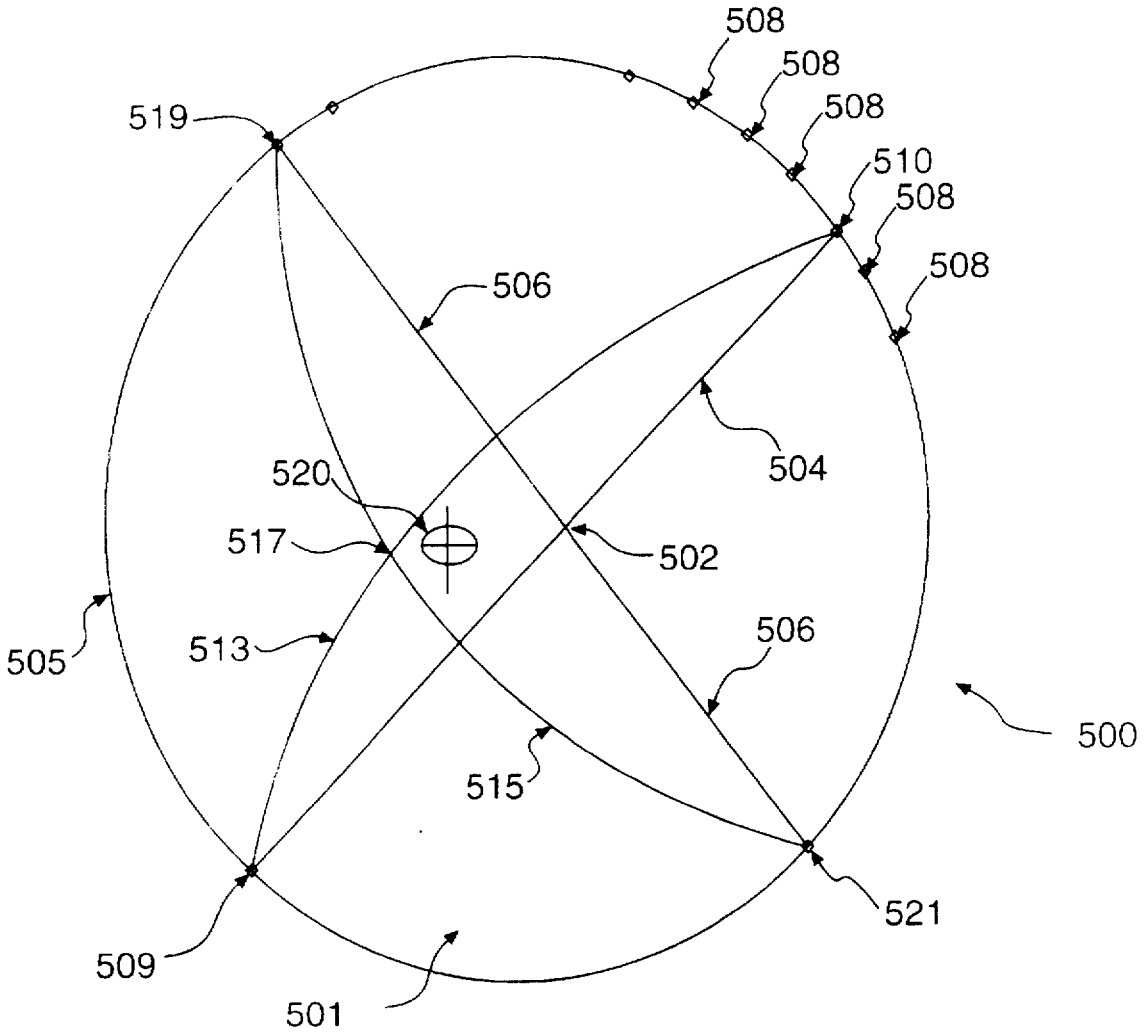
FIG. 5 illustrates a CAG according to a second preferred embodiment of the present invention.

FIG. 5 illustrates a CAG 500 according to a second preferred embodiment of the present invention. The CAG 500 has a pair of CAG lines 504 and 506 and calibration marks 508. The calibration marks 508 are located on the rim 505 of a directional antenna 501. The CAG 500 forms a crosshair gnomon 502 via the intersection of the two CAG lines 504 and 506. Preferably, the CAG lines 504 and 506 are thin opaque flexible lines of plastic string. The CAG lines 504 and 506 can be made to intersect at specific points in a plane formed by the rim 505 of the satellite dish 501. Shadows cast by the CAG lines 504 and 506 project lines 513 and 515 respectively on the face 503 of the satellite dish 501. The shadows intersect at a point 517 on the face 503 of the satellite dish 501.

The rim 505 of the antenna dish 501 is marked with calibration marks 508. Preferably, notches are placed in the dish 501 at the calibration marks 508 to facilitate holding CAG lines 504 and 506. One CAG line, e.g., CAG line 504 is strung taut across the face of the dish, in the plane formed by the rim 505. The CAG line 504 is strung from a fixed origin point, e.g., point 509 to a calibrated mark, e.g., mark 510. The CAG line 504 is secured by anchoring it to the notch located at the calibration mark 510. The second CAG line 506 is strung between two calibrated marks, e.g., marks 519 and 521, in the plane formed by the rim 505. The CAG line 506 is secured by anchoring its ends to the notches located at the calibrations marks 519 and 521.

In operation, a user obtains the requisite gnomon settings, i.e., which calibration marks to use by executing a software application. The software application returns information to the user indicating the calibration marks to which to attach the CAG lines. The user then stretches each of the two CAG lines (e.g., string or wire) between the obtained gnomon settings such that the CAG lines cross. The user maneuvers the antenna 501 until the shadow at point 517 substantially coincides with the target 520.

Figure 6:
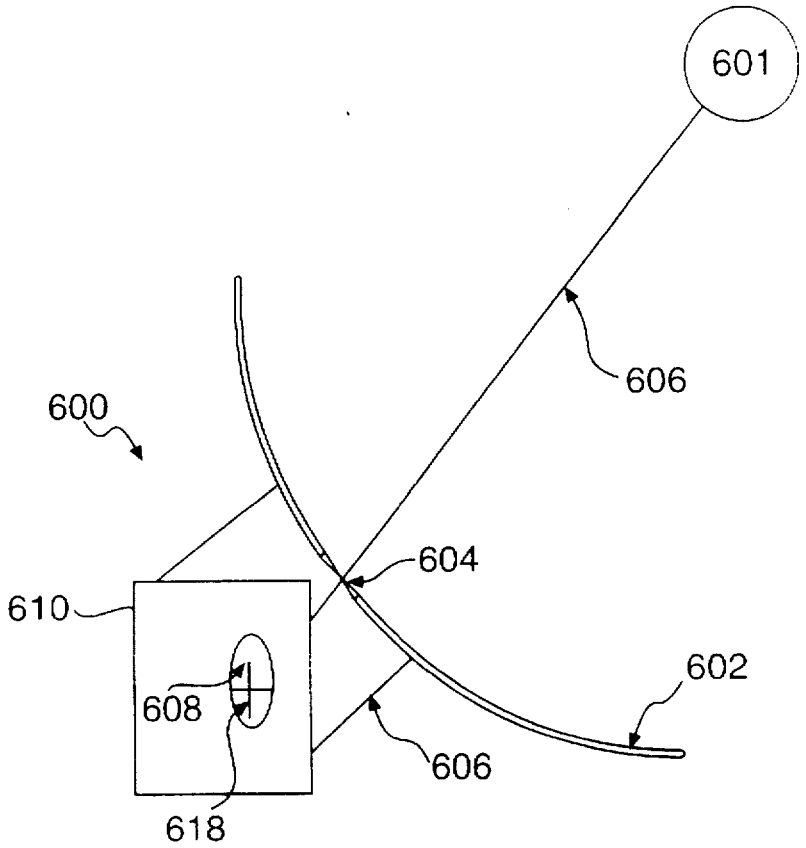
FIG. 6 illustrates a CAG according to a third preferred embodiment of the preferred invention.

A third preferred embodiment for a CAG is illustrated in FIG. 6. Referring to FIG. 6, a CAG 600 according to the third preferred embodiment of the present invention includes a fixed crosshair gnomon 604 embedded in satellite dish 602. The CAG 600 also includes a target holder 608 mounted on a mounting assembly 606. The target holder 608 contains a target 610 thereon 606. To use the CAG 600, the wave guide of the satellite dish must be mounted is such a way that the gnomon is not obstructed. For example, if the gnomon is imbedded directly in the center of the dish, the wave guide can be mounted from the rim of the dish or from a tripod. Mounting the waveguide in such a manner prevents any obstruction of light and shadow to the CAG 600.

The mounting assembly is calibrated with calibration marks. The user places the target holder 608 on the mounting assembly 606 according to calibration numbers. The user obtains the calibration numbers from a computer program specifically developed for the CAG 600 as described above. It would be apparent to those skilled in the art to develop the software based on the description herein.

In operation, the fixed crosshair gnomon 604 casts a shadow 618 having a crosshair in a spot of light onto the target holder 608. The user adjusts the satellite dish until the target 610 and the shadow 618 substantially coincide. When the target 610 and shadow 618 substantially coincide, the dish antenna 602 is properly aligned.

Figure 7:
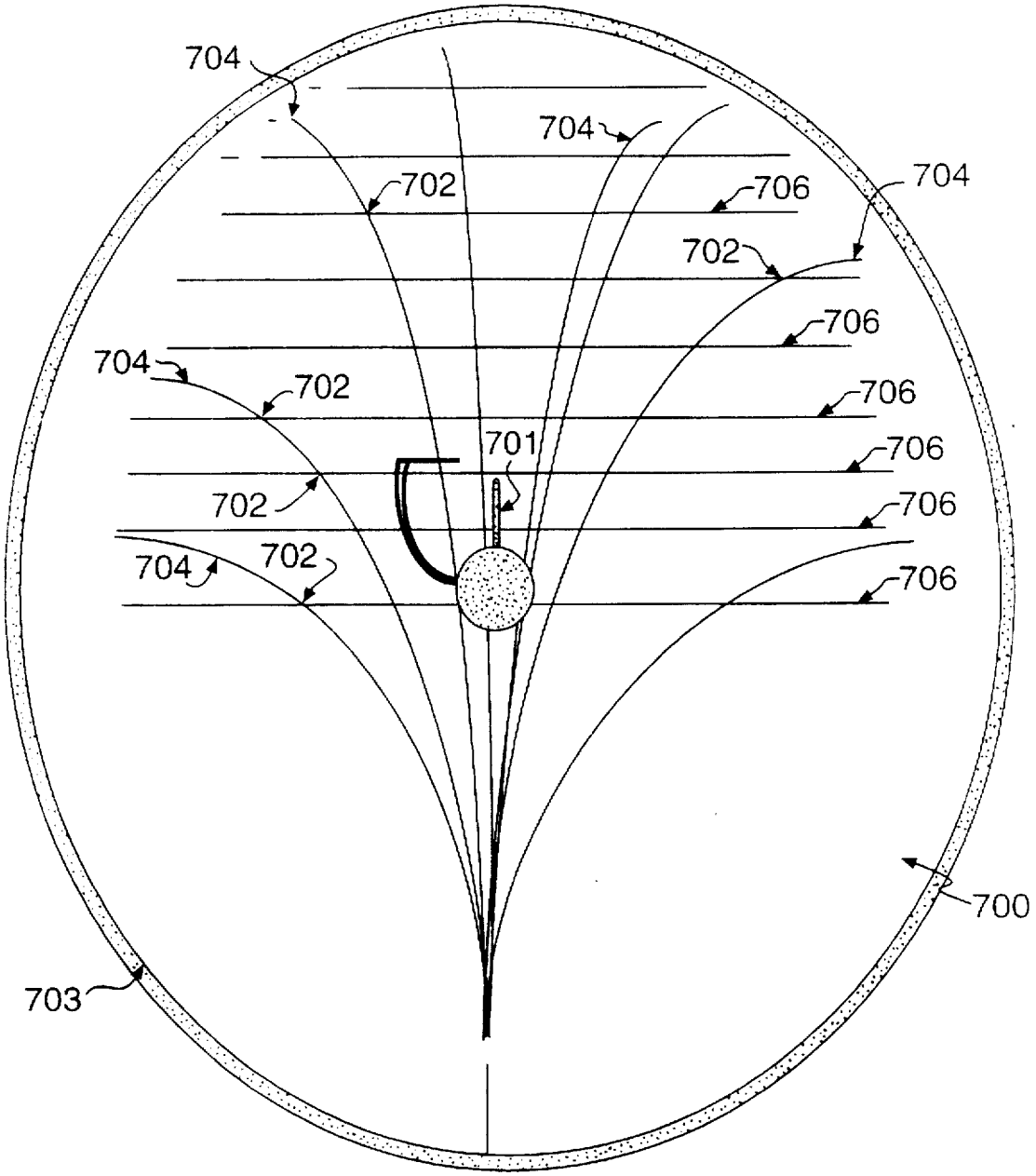
FIG. 7 illustrates a CAG according to a fourth preferred embodiment of the preferred invention.

FIG. 7 illustrates a fourth embodiment of the CAG of the present invention. Referring to FIG. 7, a CAG 700 according to the fourth preferred embodiment of the present invention comprises a fixed gnomon 701 and a plurality of targets 702 drawn on a satellite dish 703. The plurality of targets 702 makes up a target map. Each curved line 704 corresponds to a track that the sun makes over time at a given latitude on the earth. Each straight line 706 corresponds to a particular time of day.

The targets can be placed on the satellite dish in any manner including taping, marking, painting, and the like. Drawing is just one example. Moreover, the targets do not have to be placed directly on the face of the satellite dish. For example, the targets can be placed on an overlay. The overlay is placed over the satellite dish. Using an overlay allows the user to change target maps.

The gnomon 701 in the case of the fourth embodiment is fixed. That is, the user does not adjust the gnomon 701. Rather, the user determines which target is appropriate to his or her location at a particular time or a particular day. The user is generally limited to setting up the satellite dish 703 at a particular time, corresponding to one of the horizontal lines 706 on the dish 703. It would be apparent to one skilled in the art that arbitrary time resolution can be obtained by increasing the number of lines. Once the user determines the appropriate target 702, the user adjusts the satellite dish 703 until the shadow cast by the gnomon 701 substantially coincides with the desired target.

Figure 8:
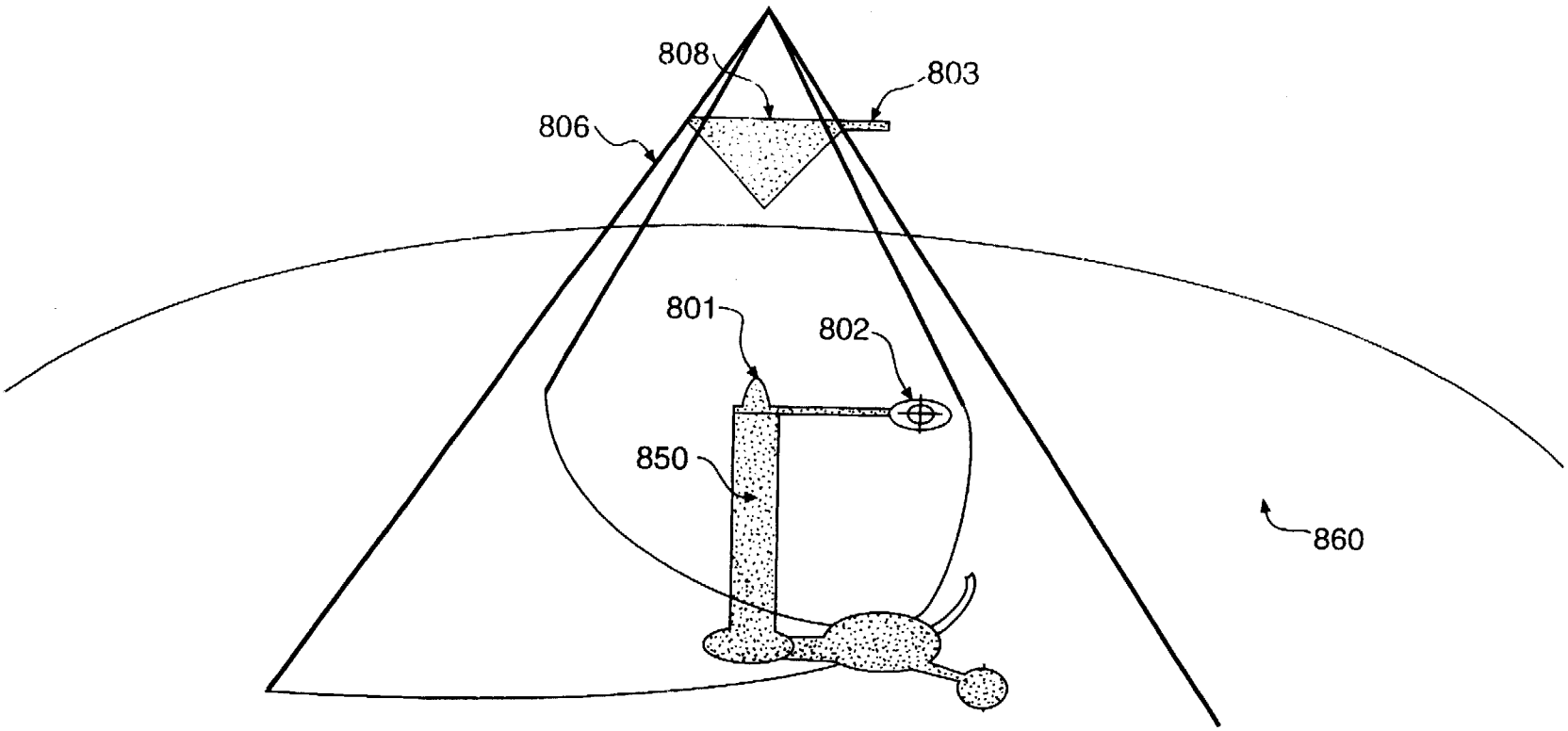
FIG. 8 illustrates a CAG according to a fifth preferred embodiment of the preferred invention.

A fifth embodiment of the present invention is illustrated in FIG. 8. Referring to FIG. 8 a CAG 800 according to the fifth preferred embodiment of the present invention has a rigid gnomon 803 and an adjustable calibrated target holder 801. The target holder 801 is mounted on the horn 850 of the dish 860. The target holder 850 holds a target 802. The face of the target is mounted in a manner similar to the CAG 100 illustrated in FIG. 9. Preferably, the gnomon 803 is attached to supports 806. Supports 806 are used to support focus element 808. In the context of the present invention, supports 806 also provide a convenient mounting location for the fixed gnomon 803. However, any rigid location on the dish 860 can be used. The user sets the adjustable target 802 according to settings returned by computer software described above. In the fifth preferred embodiment, the target shadow is not read on the surface of the dish, but rather on the target 802.

Figure 9:
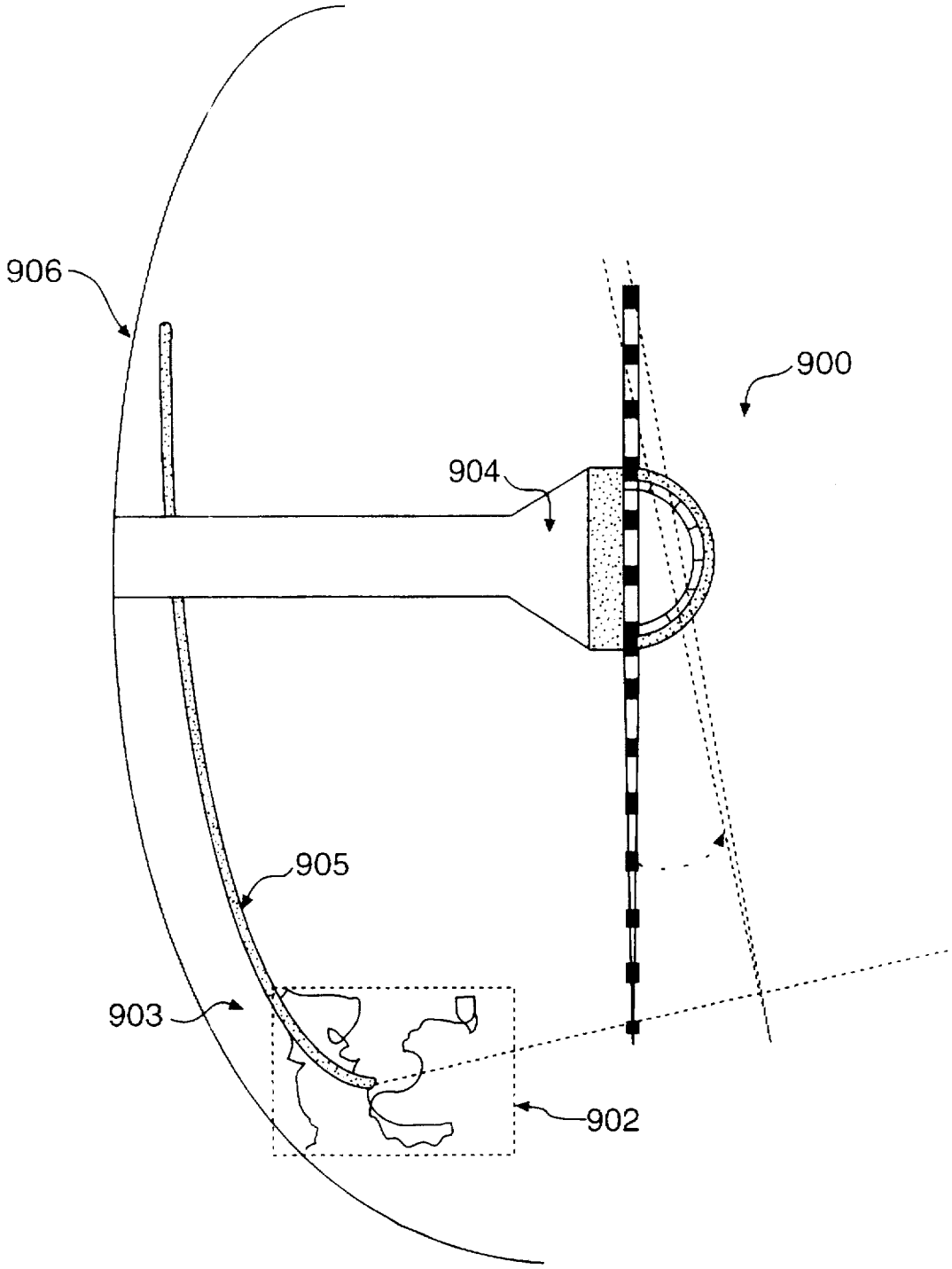
FIG. 9 illustrates a mounted CAG with the gnomon shadow hitting a target on the face of the directional antenna.
Figure 8:
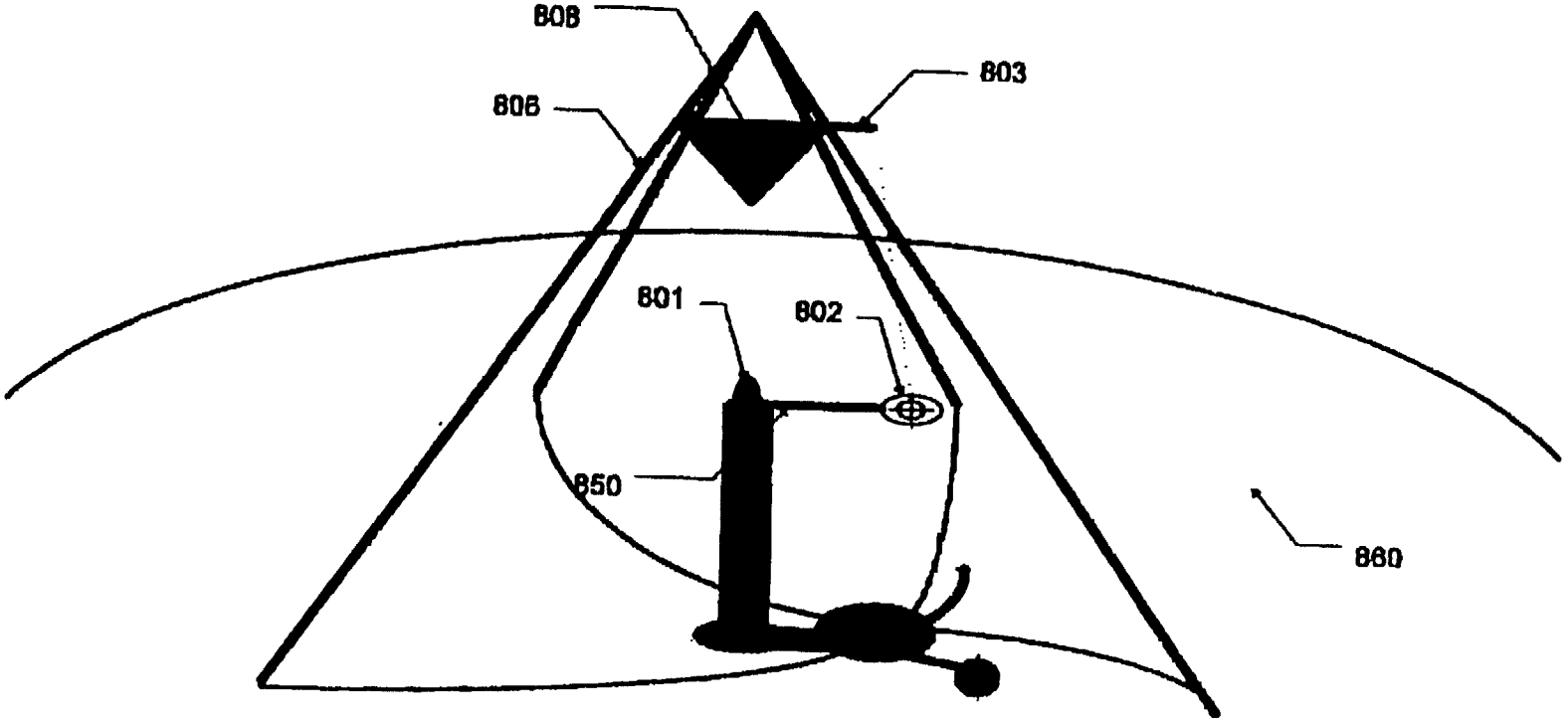

FIG. 9 illustrates a sixth preferred embodiment of the present invention. The sixth embodiment is similar to the fourth embodiment. In the sixth embodiment, a regional map 902 is superimposed on the face of the satellite dish 903. The user then adjusts the satellite dish 906 until the shadow cast by the CAG 900 substantially coincides with the user's location on the earth. In the sixth embodiment, the CAG 900 can be any CAG described herein. The CAG 900 illustrated in FIG. 9 is a CAG 400 according to the first embodiment of the present invention. The regional map 902 can be drawn on the face of the dish. Alternatively, an overlay having a map printed thereon can be used. For better resolution, the user can obtain maps that are more localized, that is, more specific to the users locality.

The foregoing embodiments for a CAG are by way of example only. It would be obvious to those skilled in the art that other embodiments are possible. Moreover, each of the foregoing embodiments can be automated. That is, the CAGs or each of the foregoing embodiments can be electrically coupled to a computer. The user inputs location (generally zip code), date, and time information to the computer. Using this information, the computer determines the appropriate adjustment settings for the CAG. The computer adjusts the CAG according to the settings. The user or an electro-mechanical device can then rotate the dish until the shadow cast by the CAG substantially coincides with the target. In the case of an electro-mechanical device, the antenna is rotated until an electrical sensor, located at the target, detects that the shadow substantially coincides with the target. Such an electrical sensor is well-known in the art. For example, an optical detector, located at the target, can be used to detect the decrease in signal energy caused when a shadow substantially coincides with optical sensor target. It would be apparent to those skilled in the art how to set up the control electronics to automate the CAGs described above.

The CAG of the present invention must be affixed to the directional antenna. Preferably, the manufacturer of the antenna attaches the CAG. How to affix the CAG depends on the particular CAG embodiment employed.

In the case of the CAG 400, the manufacture attaches the CAG 400 as illustrated in FIG. 9.

Attachment of the gnomon in the case of a CAG 500 is described above as the user stretching two CAG lines across the face of a satellite dish such that they cross.

To mount a CAG 700, the manufacturer inscribes a field of numerical lines 706 on the face of the dish or on a separate overlay. The manufacturer affixes a fixed gnomon 701 of the CAG 700 on the dish such that the tip of the fixed gnomon 701 casts a shadow at a manufacturing calibration point.

In FIG. 8, the CAG 800 is secured to the top of the wave reflector 808 of the antenna 803. Alternately, the CAG 800 can be attached to the horn support guide 806, the rim of the dish 803, or rigidly attached to any other part of the dish 803.

The CAG of the present invention can be retrofitted to an existing antenna system that does not have a pre-installed CAG. In general, retrofitting assumes that the direction of the antenna is in a discoverable orientation with respect to the sun and is properly mounted. To retrofit a CAG according to a preferred embodiment of the present invention, a user attaches a zero-set gnomon to a directional antenna. A zero-set CAG is one that is set to a pre-determined initialization configuration. Once the zero-set CAG is attached to the antenna, the user marks the point where the shadow of the sun is cast as the target. The user then notes the time, date, and location and enters that information into a computer program. The computer program uses the information and the pre-determined zero-fit configuration data to calibrate the CAG for use in future setups.

As with manufacturer mounting, retrofitting depends upon the particular CAG embodiment employed. In the case of a CAG 400, retrofitting can be accomplished by attaching the CAG 400 to the antenna and inscribing a target on the face of the dish by calibration with a known light source. The CAGs of the present invention can have an installation setting. The installation setting is such that when the known light source is aimed to the target on the directional antenna and the CAG is set so that the gnomon shadow substantially intersects with the target, the focus aim of the antenna is known.

As long as the existing satellite dish is properly aimed to a known satellite, the setup software can be used to install the CAG 400 which can then be utilized for aiming to other satellites. The user places a target on the illuminated portion of the dish. The user then zero-sets the CAG. After zero-setting the gnomon, the user affixes the CAG to the fully aimed dish such that the gnomon shadow substantially intersects with the target. The user then notes the tune of day, the date and the location of the satellite dish and the gnomon settings on the CAG. The user enters this information into a computer executing a computer program. The computer program uses the information to calibrate the CAG for the obtained by the known light source.

In the case of a CAG 500, a user can retrofit the CAG 500 by marking the rim of the satellite dish antenna in standard radians of degrees, minutes, and seconds of arc. A rim overlay can be used as well. The rim overlay is pre-marked with degrees labels. The top of the dish is labeled 0/360. The user calibrates the gnomon by inputting the zip code of the antenna's location, the date, and the time. The software outputs to the user the requisite points at which to affix the CAG lines, such that a shadow falls onto the face of the dish. The user who wishes to retrofit now marks the target on the face of the dish where the gnomon shadow falls.

For a CAG 700, a user can retrofit the gnomon by setting a fixed gnomon and inscribing a field of target on the face of the dish. The user can calibrate the CAG 700 during solar occultation (when the sun is directly to the south (behind) the satellite of interest). To calibrate the CAG 700 during the solar outage, the user selects the target at which the fixed gnomon shadow is cast. The user further marks the face of the dish at differing times of the day and year. Further target markings on the face of the dish can be accomplished by specific calculations specific to the size of the dish and other data such as the satellite location, day and time.

For a retrofit of the CAG consisting of a fixed gnomon and an adjustable target illustrated in FIG. 8 the user attaches the fixed gnomon and target holder to an existing directional antenna such that the zero-set adjustable target and the gnomon shadow substantially intersect. This action should be performed at local noon time or any time when substantial illumination can fall on the CAG.

Throughout this specification numerous references are made to a satellite dish antenna, or satellite dish. It should be noted that a satellite dish antenna is an example of a directional antenna. The satellite dish antenna is used to provide a familiar example to facilitate disclosure of the present invention, and is not intended to limit the concept of directional antenna in any way. It would be obvious to those skilled in the art that the CAG of the present invention can be used with any directional antenna, of which a satellite dish antenna is merely an example.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims appended hereto, and by their equivalents.

What is claimed is:

1. A method for aiming a mounted directional antenna having a predetermined target to an associated transmitter or receiver, comprising the steps of:

a) obtaining setting information for an adjustable gnomon;

b) adjusting said adjustable gnomon according to said setting information; and c) aligning the mounted antenna such that a shadow substantially coincides with the predetermined target to thereby aim the antenna.

2. The method as recited in claim 1, wherein step (a) further comprises:

(i) entering location information into computer software, said computer software executing on a computer to output said setting information; and (ii) obtaining said setting information from said output of said computer software.

3. The method as recited in claim 1, wherein step (b) further comprises:

(i) rotating said adjustable gnomon in azimuth according to said setting information;

(ii) rotating said adjustable gnomon in elevation according to said setting information; and (iii) moving said adjustable gnomon along its transversal axis according to said setting information; and (iv) locking said adjustable gnomon into place after performing step (I) through step (iii).

4. The method as recited in claim 1, wherein step (b) further comprises:

(i) placing a first CAG line across said directional antenna, according to said setting information; and (ii) placing a second CAG line across said directional antenna according to said setting information such that said second CAG line crosses said first CAG line.

5. The method as recited in claim 4, wherein said first CAG line has a first end and a second end, said first end permanently attached to a predetermined point and wherein:

step (i) comprises the step of affixing said second end to a point according to said setting information and step (ii) comprises the step of affixing each end of said second CAG line to distinct point according to said setting information.

6. The method as recited in claim 1, wherein step (b) comprises the steps of:

(i) attaching a target to a target holder; located behind said directional antenna;

(ii) positioning said target holder in accordance with said setting information; and (iii) locking said target holder in place.

7. The method as recited in claim 1, wherein step (c) comprises the step of:

rotating said directional antenna until said shadow substantially coincides with said target.

8. An apparatus for aiming a directional antenna based on adjustable gnomon setting information, comprising:

a gnomon having calibration marks; and adjusting means for adjusting said gnomon according to said setting information using said calibration marks.

9. The apparatus as recited in claim 8, wherein said adjusting means comprises:

first rotating means for adjusting said gnomon in azimuth;

second rotating means for adjusting said gnomon in elevation; and transversal adjusting means for adjusting said gnomon along its transversal axis.

10. The apparatus as recited in claim 8, wherein said calibration marks are located on said directional antenna and wherein said adjusting means comprises:

a plurality of CAG lines, wherein said CAG lines extend between calibration marks according to said setting information, such that said plurality of CAG lines cross, thereby forming a cross shadow pattern on said directional antenna.

11. The apparatus as recited in claim 10, wherein said lines are secured in place by notches co-located with said calibration marks.

12. The apparatus as recited in claim 11, wherein there are two CAG lines.

13. The apparatus as recited in claim 8, wherein said calibration marks comprises:

first marking and lines corresponding to the time of day; and second markings lines corresponding to the position of the sun at a given time of day at a particular location on the earth, wherein the intersection of a first marking line and a second marking line is a target corresponding to a particular location at a particular time.

14. The apparatus as recited in claim 8, wherein said adjusting means comprises:

a target holder located behind said directional antenna, said target holder can be movably displaced behind said directional antenna, said target holder holding a target.

15. A directional antenna having a predetermined target located thereon, comprising:

an adjustable gnomon for aiming the directional antenna to a transmitter or receiver, one or more calibration marks located on said adjustable gnomon that indicate calibration settings for adjusting said adjustable gnomon to aim the directional antenna toward an associated transmitter or receiver; and aligning means for aligning said directional antenna such that a shadow cast by said adjustable gnomon substantially coincides with the predetermined target to thereby aim the directional antenna.

16. The directional antenna of claim 15, wherein said adjustable gnomon:

first rotating means for adjusting said gnomon in azimuth;

second rotating means for adjusting said gnomon in elevation; and transversal adjusting means for adjusting said gnomon along its transversal axis.

17. The directional antenna of claim 15, wherein said calibration marks are located on a face of the directional antenna and wherein said adjusting means comprises:

a plurality of CAG lines, wherein said CAG lines extend between calibration marks according to setting information, such that said plurality of CAG lines cross, thereby forming a cross shadow pattern on said directional antenna.

18. A directional antenna system for aiming a directional antenna toward an associated transmitter or receiver, comprising:

a directional antenna, having a predetermined target located thereon;

an adjustable gnomon for aiming said directional antenna to the transmitter or receiver;

one or more calibration marks located on said adjustable gnomon that indicate calibration settings for adjusting said adjustable gnomon to aim the directional antenna toward an associated transmitter or receiver; and aligning means for aligning said directional antenna such that a shadow cast by said adjustable gnomon substantially coincides with the predetermined target to thereby aim the directional antenna.

19. The directional antenna system of claim 18, further comprising:

a computer to calculate setting information which indicates which of said one or more calibration marks are to be used in adjusting said adjustable gnomon; and adjusting means for adjusting said adjustable gnomon according to said setting information.

20. The directional antenna system of claim 19, wherein said computer farther comprises input means for entering location information into computer software, said computer software executing on said computer to output said setting information.

* * * * *

UNITED STATES PATENT AND TRADEMARK OFFICE

CERTIFICATE OF CORRECTION

PATENT NO. : 5,760,739

DATED : 6/2/98

INVENTOR(S) : Pauli

It is certified that error appears in the above-identified patent and that said Letters Patent is hereby corrected as shown below:

Delete the Drawing Sheet 10 of 11, and substitute therefor the Drawing sheet, consisting of Fig. 8, as shown on the attached page.

Column 10, line 20, replace "850" with --801--.

Signed and Sealed this

Ninth Day of March, 1999

*Attest:*

*Attesting Officer*

Q. TODD DICKINSON

*Acting Commissioner of Patents and Trademarks*